United States Patent [19]

Starnes, Jr.

[11] 4,372,539

[45] Feb. 8, 1983

[54] RENEWABLE, STRAND CENTERING ANNEALER SHEAVE

[75] Inventor: Ralph E. Starnes, Jr., Carrollton, Ga.

[73] Assignee: Southwire Company, Carrollton, Ga.

[21] Appl. No.: 269,176

[22] Filed: Jun. 2, 1981

[51] Int. Cl.[3] ..... C21D 9/62; H05B 3/00

[52] U.S. Cl. ..... 266/104; 339/5 RL; 219/155

[58] Field of Search ..... 266/249, 104; 148/150, 148/154, 156, 128, 129, 13 R; 219/155, 119; 339/5 RL

[56] References Cited

U.S. PATENT DOCUMENTS

| | | | |
|---|---|---|---|
| 1,993,400 | 12/1930 | Convers | 148/13 |
| 2,726,971 | 10/1950 | O'Grady | 266/104 X |
| 3,746,582 | 7/1973 | Gentry | 148/13 |
| 3,799,518 | 3/1974 | Barone | 266/104 X |
| 3,989,923 | 11/1976 | Lees et al. | 339/5 RL X |
| 4,116,422 | 9/1978 | Vogel et al. | 266/104 |
| 4,117,295 | 9/1978 | Beach | 266/104 X |

FOREIGN PATENT DOCUMENTS

| | | | |
|---|---|---|---|
| 2520161 | 11/1975 | Fed. Rep. of Germany | 266/104 |
| 50-07526 | 3/1975 | Japan | 266/104 |

*Primary Examiner*—M. J. Andrews
*Assistant Examiner*—David A. Hey
*Attorney, Agent, or Firm*—Herbert M. Hanegan; Stanley L. Tate; Robert S. Linne

[57] ABSTRACT

Disclosed is an improved system for annealing strand of the type comprising at least two sheaves across which the strand passes and becomes electrically annealed, the improvement comprising a first flange member, a second flange member concentric with the first flange member and adjacent thereto, and an annealing band positioned between the first and second flange members and forming the bottom of a sheave groove, further provided that the annealing band is adapted to center strand being annealed to prevent contact between the strand and either of the flange members thereby providing a renewable, strand centering annealer sheave adapted for long life.

10 Claims, 2 Drawing Figures

RENEWABLE, STRAND CENTERING ANNEALER SHEAVE

BACKGROUND

The present invention relates generally to annealing, and specifically to an annealing sheave comprising a renewable, annealer band adapted to continuously physically and magnetically center the strand being annealed to increase band and sheave longevity, and adapted to prevent arcing.

Annealing is the well known art of heat treating metals and is used to strengthen strands of metal such as wire or cable. The early art introduced batches of product into an oven for annealing but the process was slow and expensive. Continuous processes such as those shown in U.S. Pat. Nos. 1,993,400 and 2,726,971 were developed to continuously anneal wire by passing it along a series of rollers which apply electric current to the advancing wire to heat it as desired. A similar process for annealing cable is taught by U.S. Pat. No. 3,746,582. Originally, the rollers comprised sheaves having a groove in which the advancing strand traveled. It was found that the strand quickly wore out the sheaves because of continuous abrasion so replaceable sheave inserts such as the one shown in West German Pat. No. DT 25 20 161 were developed.

The insert is normally an endless flat strip forming the base of the groove while the sheave portions form the side walls. Although the replacable insert decreases wear on the sheaves somewhat, sheave wear has remained unacceptably high until the present invention because the strand had no propensity to remain in contact only with the insert. Instead, the strand normally moved to one side and began to wear the sheave wall. In addition to having no tendency to remain centered on the insert surface, the strand even if not a magnetic material is often actually attracted to one side by the eddy current fields which are influenced by the mass of the annealer structure.

In addition to wearing out the inner flange surfaces of the sheaves, the strand quickly wears out the insert which is designed to receive the bulk of the wear. Another problem is arcing which causes burn pits to the strand and to the sheaves. The present invention solves the sheave wear and arcing problems by providing an annealing sheave comprising annealer band which continuously centers the strand, extends the life of the band by having a renewable surface, and eliminates detrimental arcing by having certain insulated surfaces.

SUMMARY OF THE INVENTION

The present invention is a renewable strand centering annealer sheave. It comprises an inward crowned annealer band which physically guides the strand being annealed into the center groove thereof to prevent abrasion to other portions of the sheave. The band is made of magnetic material which provides balanced magnetic influence to the eddy current fields surrounding the strand thereby assisting guidance of the strand in the inward crown. A non-conductive surface is provided at the sheave flanges to prevent arcing and a metal spray protective coating is applied to the strand contacting area of the annealer band to provide resistance to wear. Thus both the sheave and band portions of the present invention have greatly extended lives.

Therefore, a major object of this invention is to provide a renewable, strand centering annealer sheave adapted to anneal wire or cable, having extended useful life, and adapted to prevent arcing.

BRIEF DESCRIPTION OF THE DRAWINGS

While the specification concludes with claims particularly pointing out and distinctly claiming the subject matter which is regarded as the invention, it is believed that the invention, objects, features, and advantages thereof will be better understood from the following description taken in connection with accompanying drawings in which like parts are given like identification numerals and wherein:

DESCRIPTION OF THE PREFERRED EMBODIMENT

The present invention is a renewable, strand centering annealer sheave. As FIG. 1 illustrates, the sheave 10 is part of an annealing system which cooperates with similar sheaves and electrical current control means to apply a current to a length of strand 11 such as wire or cable between two sheaves thereby heating and annealing the strand 11.

Figure 1:
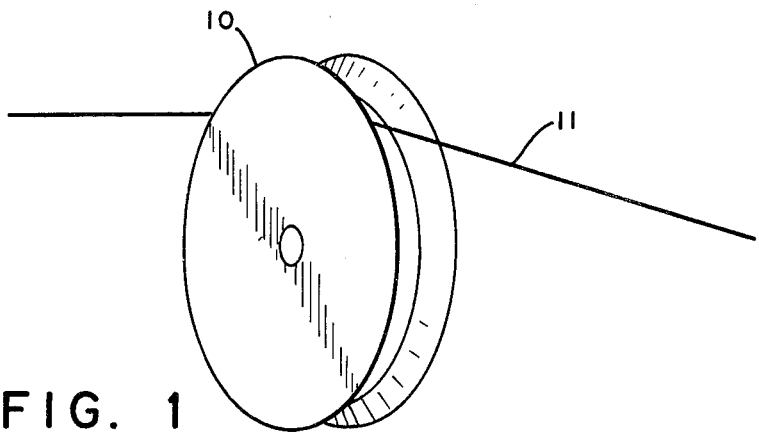
FIG. 1 is a perspective view of a portion of a strand annealing machine comprising the present invention.
Figure 2:
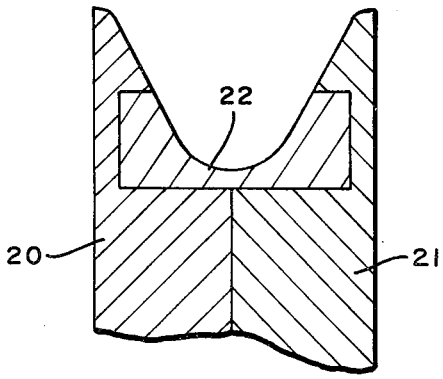
FIG. 2 is a partial cross sectional view of the sheave and band of the present invention.

In FIG. 2 it can be seen that the sheave 10 of FIG. 1 comprises a first flange 20, a second flange 21 and an annealer band 22. The band 22 is inward crowned to physically guide strand 11 into the center groove thereof to prevent abrasion to the flanges 20 and 21 thus greatly increasing their lives. The band 22 is made of magnetic material such as steel which provides balanced influence to the eddy current field surrounding the strand 11 thereby assisting guidance of the strand 11 in the inward crown of the band 22 to additionally assure longevity of the flanges 20 and 21. To increase the life of the band 22, a metal spray protective coating is applied to the strand contacting area of the annealer band 22. In addition, flanges 20 and 21 are made of insulator material or a non-conductive metalizing spray is applied to bronze flanges 20 and 21 to prevent arcing.

While the spray processes used for applying the protective coating and the non-conductive coating may be any process adapted to bond the materials to the surfaces properly, fuse welding, gas spray welding, electrical arc spraying, plasma spraying and detonation gun application are preferred and the most desirable are plasma spraying and detonation gun application because strong bond with the substrate metal is achieved.

The protective coating on the annealer band 22 should be thickest at the inner crown to prolong wear. The protective coating may be chosen from alloys of cobalt, nickel alloys and tungsten carbide alloys, but the preferred material is a tungsten carbide alloy.

The non-conductive coating sprayed onto the metal flanges 20 and 21 may be a ceramic or an oxide of chrome or aluminum. The preferred spray is aluminum oxide.

The flanges 20 and 21 may also be adapted with non-conductive inner surfaces by providing composite flanges with laminated surfaces of an electrical grade insulator material such as synthetic resins, plastics, and castable ceramics.

Thus, while wear of the band 22 is greatly reduced, wear of the flanges 20 and 21 and burn pitting of the sheave 10 and the strand 11 are substantially eliminated.

While this invention has been described in detail with particular reference to a preferred embodiment thereof, it will be understood that variations and modifications can be effective within the spirit and scope of the invention as described hereinbefore and as defined in the appended claims.

I claim:

1. In a system for annealing strand of the type comprising at least two sheaves across which said strand passes and becomes electrically annealed, the improvement comprising:

a first flange member;

a second flange member concentric with said first flange member and adjacent thereto; and an annealing band positioned between said first and second flange members and forming the bottom of a sheave groove;

further provided that said annealing band comprises an inward crowned central groove which physically guides said strand centrally.

2. The apparatus of claim 1 wherein said band has a metal spray protective coating applied to the strand contacting area thereof and is adapted to be repeatedly renewed by subsequent application of metal spray protective coating.

3. The apparatus of claim 2 wherein said protective coating is selected from the group consisting of cobalt alloys, nickel alloys and tungsten carbide alloys.

4. The apparatus of claim 1 wherein said flange portions have a non-conductive inner surface to prevent detrimental arcing.

5. The apparatus of claim 7 wherein said flange portions are bronze and have inner surfaces of non-conductive metalizing spray coating.

6. The apparatus of claim 5 wherein said coating is selected from a group composed of ceramics, chrome oxide, and aluminum oxide.

7. The apparatus of claim 4 wherein said flange portions are composite members having laminated surfaces of an electrical grade insulator.

8. The apparatus of claim 7 wherein said insulator is selected from the group consisting of synthetic resins, plastics and castable ceramics.

9. In a system for annealing strand of the type comprising at least two sheaves across which said strand passes and becomes electrically annealed, the improvement comprising:

a first flange member;

a second flange member concentric with said first flange member and adjacent thereto; and an annealing band positioned between said first and second flange members and forming the bottom of a sheave groove;

further provided that said annealing band comprises an inward crowned central groove and is made of magnetic material such that an eddy current field surrounding said strand is guided by balanced magnetic force toward said inward crown thereby guiding said strand centrally into said inward crown.

10. The apparatus of claim 9 wherein said magnetic material is steel.

* * * * *